United States Patent [19]

Camp

[11] Patent Number: 5,054,624

[45] Date of Patent: Oct. 8, 1991

[54] JEWELRY CADDY

[76] Inventor: Betty J. Camp, 3125 Mackey La., Shreveport, La. 71118

[21] Appl. No.: 375,679

[22] Filed: Jul. 5, 1989

[51] Int. Cl.[5] ..... A47F 7/00

[52] U.S. Cl. ..... 211/13; 211/163

[58] Field of Search ..... 211/13, 163, 205; 108/103; 206/486, 487, 566

[56] References Cited

U.S. PATENT DOCUMENTS

| | | | |
|---|---|---|---|
| 770,756 | 9/1904 | Hynek | 211/163 X |
| 3,319,800 | 5/1967 | Bowles | 211/163 |
| 4,126,366 | 11/1978 | Handler et al. | 211/163 X |
| 4,291,811 | 9/1981 | Shaver | 211/205 |
| 4,614,272 | 9/1986 | Shelton et al. | 211/13 X |
| 4,850,658 | 7/1989 | Sandor | 211/13 X |

*Primary Examiner*—Sarah A. Lechok

*Attorney, Agent, or Firm*—John M. Harrison

[57] ABSTRACT

A jewelry caddy which is characterized in a first preferred embodiment by a base, a support rod upward-standing from the base, a top strut frame attached to the top end of the support rod, a slat frame fitted over the support rod and the top strut frame and extending to a point above the base, and multiple, curved slats removably clipped to the slat frame and fitted with holes for mounting ear screws thereon. The strut frame is characterized by spaced, horizontal, outwardly-extending, elongated struts having upward-turned tips for receiving such jewelry items as beads, rings and the like. In a preferred aspect of the invention a strip of foam rubber or like resilient material is attached to the inside concave surface of the curved slats to facilitate mounting a retainer on the post of the ear screws when the post is projected through a hole in one of the slats. In another preferred embodiment of the invention the jewelry caddy is provided with a bracket for mounting on a wall and includes a pair of oppositely-disposed, spaced strut frames mounted on the support rod, along with the slat frame, wherein the entire jewelry caddy 1 is supported by the bracket on a wall. In still another preferred embodiment, perforated slats are mounted on horizontal post struts attached to vertical posts which are mounted on a tray designed to receive such items as change, a watch, rings, a wallet and the like.

4 Claims, 2 Drawing Sheets

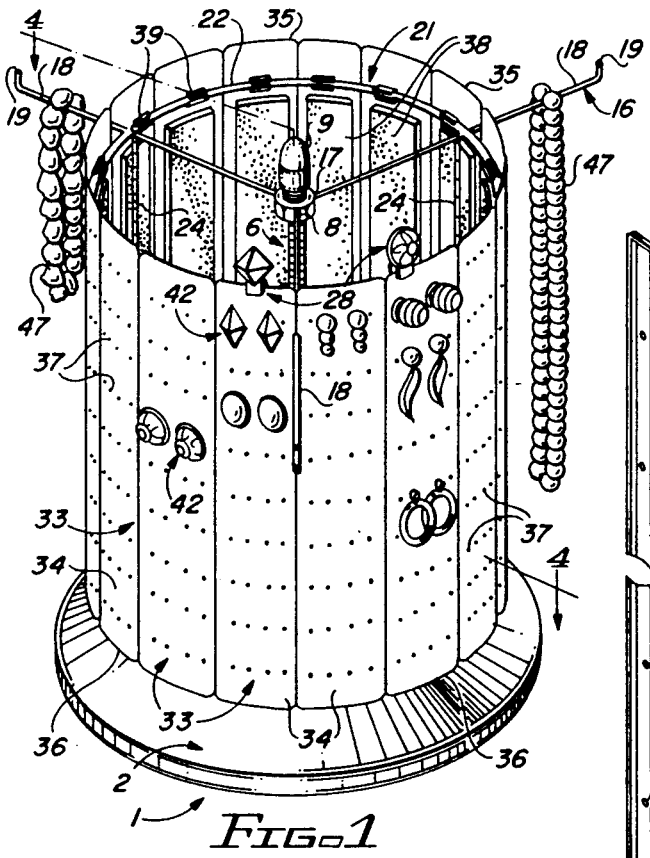
FIG. 1
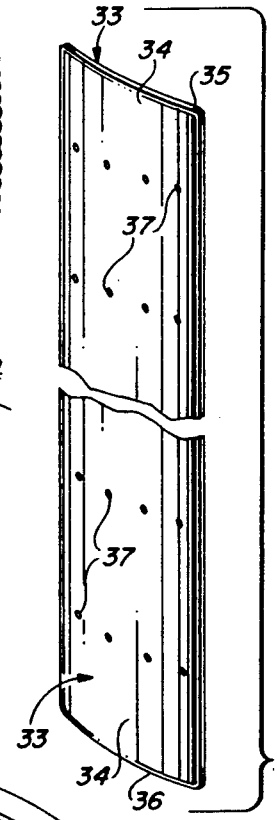
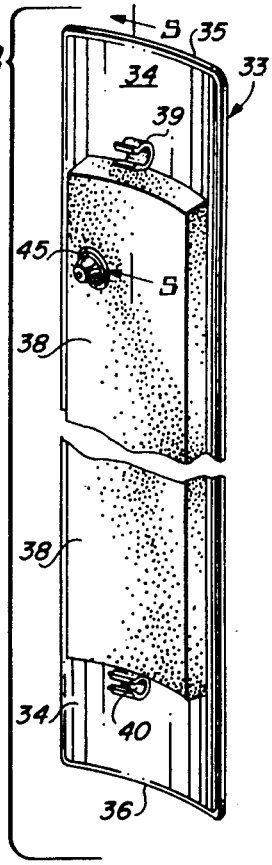
FIG. 3
FIG. 2
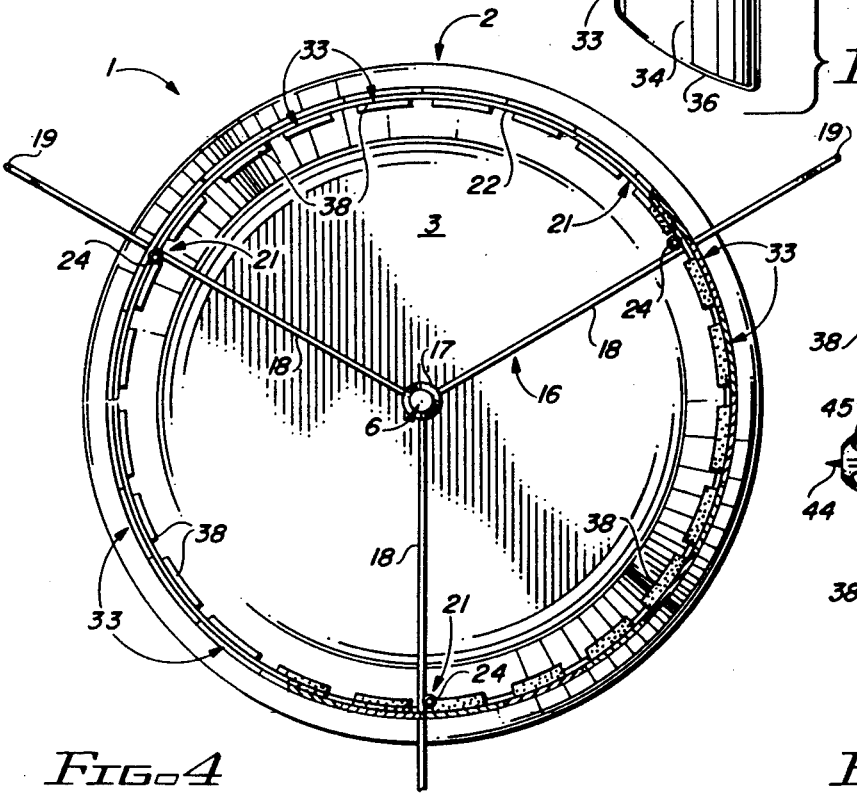
FIG. 4
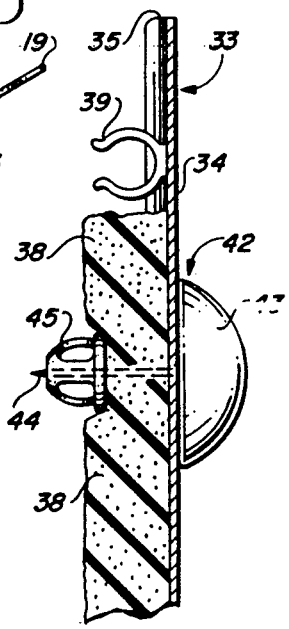
FIG. 5

JEWELRY CADDY

BACKGROUND OF THE INVENTION

1. Field of the Invention

This invention relates to devices for organizing and storing jewelry and more particularly, to a jewelry caddy which is characterized in a first preferred embodiment by a base for resting on a supporting object, a support rod upward-standing from the base, a top strut frame adapted for seating on the rod and having spaced, horizontal, outwardly-extending struts for receiving, supporting and organizing beads, rings and other jewelry, and a slat frame resting on the top strut frame and having a pair of horizontally spaced rings adapted to receive multiple, curved slats for receiving, supporting and organizing earrings, stick pins and similar jewelry. In another preferred embodiment, a bracket is provided on the support rod for mounting the jewelry caddy on a wall, wherein the base is removed and a second strut frame is mounted to the bottom of the support rod to provide additional struts for supporting beads, rings and other jewelry. In a third embodiment of the invention the slats are mounted on horizontal, spaced post struts attached to vertical posts which are secured to a tray designed to receive and support such items as change, a watch, rings, a wallet and like items.

One of the problems realized in storing, displaying and organizing jewelry is that of providing a suitable jewelry container or box which will adequately display the jewelry and organize it for easy selection when needed. Since various jewelry designs and colors should be worn in specific combinations with certain clothing, under normal circumstances the selection process frequently requires that all, or at least a part of, the jewelry which is located in a conventional jewelry box be removed from the box. This selection technique is slow and laborious and must be undertaken each time the jewelry is worn.

2. Description of the Prior Art

Various types of jewelry caddies, organizers and racks are known in the art, including assorted racks and displays which have been developed for commercially displaying jewelry of various design. However, in most cases, jewelry which is kept at home is stored in a jewelry box, tray or other container that may be equipped with compartments, drawers and the like, in an attempt to organize various jewelry pieces. U.S. Pat. No. 3,997,050, dated Dec. 14, 1976, to Chad W. Patterson, details a "Jewelry Caddy" which can be used to display jewelry, both commercially and privately. The jewelry caddy includes a base structure having an upstanding, rotating element which is fitted with multiple projections adapted to hold articles of jewelry. A layer of soft material such as cork, which can be easily penetrated by a needle or a pin, covers at least a portion of the surface of the upstanding element, whereby jewelry or other items having pin-type attachments can be pinned to the material for convenient display and storage. A similar "Display Device" is detailed in U.S. Pat. No. 4,040,520, dated Aug. 9, 1977, to Gene Joaquin. The device is designed to display relatively small articles and includes a wedge-shaped support having multiple exterior faces, each having support means for holding a removable display board. Each board is adapted to be pre-loaded with articles to be displayed before being installed on a face of the support, which is mountable on a rotatable base. U.S. Pat. No. 4,253,576, dated Mar. 3, 1981, to Allan L. Ford, details a "Belt Fixture and Method of Using Same". The belt fixture includes a rack having multiple segments, each segment of which includes multiple, horizontally-extending spokes. The segments further include color indicia, with the color of each segment being different from the colors of the other segments. Belts are suspended by hang tags, which are releasably placed on the spokes. The hang tags have the same color as the color applied to its associated segment and the colors are used to segregate belts on the rack by style. A "Theft-Preventive Jewelry Display Stand" is detailed in U.S. Pat. No. 4,463,856, dated Aug. 7, 1984, to Andy Strasser. The jewelry display stand includes multiple, substantial vertical, rectangular side panels of equal height connected to each other at their vertical edges and mounted on and secured to a preferably circular, flat bottom piece. One of the side panels may be a mirror panel, but at least one of the side panels is also a display panel having multiple, vertically-oriented display arms extending perpendicularly therefrom, parallel to the vertical edges of the display panel. Adjacent display arms contain opposing vertical slots running the length of the display arms. The slots are of such depth that rectangular jewelry display cards having earrings and the like attached thereto may be slidably mounted and held on the display panel. The jewelry display stand is also provided with a detachable, decorative lid which is designed to cover the top of the side panels, and vertical slots are included to prevent theft of jewelry mounted on the display cards. The jewelry display stand may be made rotatable by attaching the bottom piece to a rotatable base. U.S. Pat. No. 4,480,755, dated Nov. 6, 1984, to Jerry G. Cartwright, details a "Tool Storage Device". The tool storage device includes a cabinet having multiple, vertically-arranged, planar side walls, each containing multiple apertures adapted to receive a portion of a support hook. The cabinet also includes an internal assembly for locking the hook portions within the apertures to provide a stable support for hand tools and the like. The locking assembly includes multiple locking plates arranged in parallel, spaced relationship with respect to the cabinet side walls, respectively, and a rotatable cam for displacing the locking plates relative to the side walls between locked positions in which the locking plates press the hook portions against the inner surfaces of the associated side walls, respectively, and unlocked positions, in which the locking plates release the hook portions, respectively.

It is an object of this invention to provide a jewelry organizer and caddy which includes a base, a support rod upward-standing from the base and a slat frame supported by the support rod and adapted to receive multiple, curved slats provided with holes for receiving, mounting and displaying earrings.

Another object of this invention to provide a new and improved jewelry caddy which is characterized by a base, a support rod extending upwardly from the base, at least one strut frame attached to the support rod and extending therefrom for receiving beads, rings and other jewelry and further including a circular frame member supported by the strut frame and multiple slats removably secured to the frame member and provided with openings for receiving ear screws and other jewelry in removable relationship.

Still another object of the invention is to provide a new and improved jewelry caddy which is characterized by a base member, a support rod vertically upward-standing from the center of the base member, a strut frame secured to the support rod and having radially outwardly-extending struts for mounting beads, rings and other items of jewelry thereon, a round slat frame supported by the strut frame and a plurality of slats removably mounted on the slat frame and provided with openings for receiving, mounting and organizing ear screws and other pieces of jewelry.

Still another object of this invention is to provide a jewelry caddy which is characterized by a slat frame having a vertically-oriented central rod with top and bottom strut frames mounted thereon, which strut frames each have radially-extending struts for supporting beads, rings and other jewelry further including a pair of frame rings disposed on and attached to the strut frames and designed to receive multiple, curved slats, which slats are perforated for receiving and mounting earrings thereon and further including a bracket attached to the rod for mounting the jewelry caddy on a wall.

Yet another object of the invention is to provide a jewelry caddy having a tray for receiving such items as change, a watch, a wallet and the like, vertical posts mounted on the tray and horizontal struts connecting the posts for supporting multiple, perforated slats adapted to receive and mount earrings thereon.

SUMMARY OF THE INVENTION

These and other objects of the invention are provided in a new and improved jewelry caddy and organizer which is characterized in a first preferred embodiment by a base and a support rod having a threaded end extending vertically from the center of the base. A top strut frame is attached to the upper end of the support rod and includes horizontal, radially-oriented struts for hanging beads, rings and similar items of jewelry and an upward-standing cap nut is threaded on the upper end of the support rod to receive a watch or ring and retain the strut frame on the support rod. A slat frame having a pair of horizontally-disposed, circular rings is mounted on the strut frame and multiple, curved, perforated slats are removably clipped to the rings for receiving ear-screws and other jewelry pieces. In another preferred embodiment of the invention a bottom strut frame replaces the jewelry caddy base on the lower end of the support rod and a bracket is mounted on the support rod for securing the jewelry caddy on a wall. In yet a third preferred embodiment of the invention,. a tray designed for receiving change, a wallet, a watch and the like, is provided with upward-standing, spaced posts connected by a pair of horizontal post struts for receiving multiple, perforated slats and organizing earrings and other jewelry.

BRIEF DESCRIPTION OF THE DRAWINGS

The invention will be better understood by reference to the accompanying drawings, wherein:

FIG. 1 is a perspective view of a first preferred embodiment of the jewelry caddy of this invention;

FIG. 2 is a perspective view of the outside surface of a preferred perforated slat element of the jewelry caddy illustrated in FIG. 1;

FIG. 3 is a perspective view of the inside surface of the slat element illustrated in FIG. 2;

FIG. 4 is a sectional view taken along line 4—4 of the jewelry caddy illustrated in FIG. 1;

FIG. 5 s a sectional view taken along line 5—5 of the slat illustrated in FIG. 3;

DESCRIPTION OF THE PREFERRED EMBODIMENTS

Figure 6:
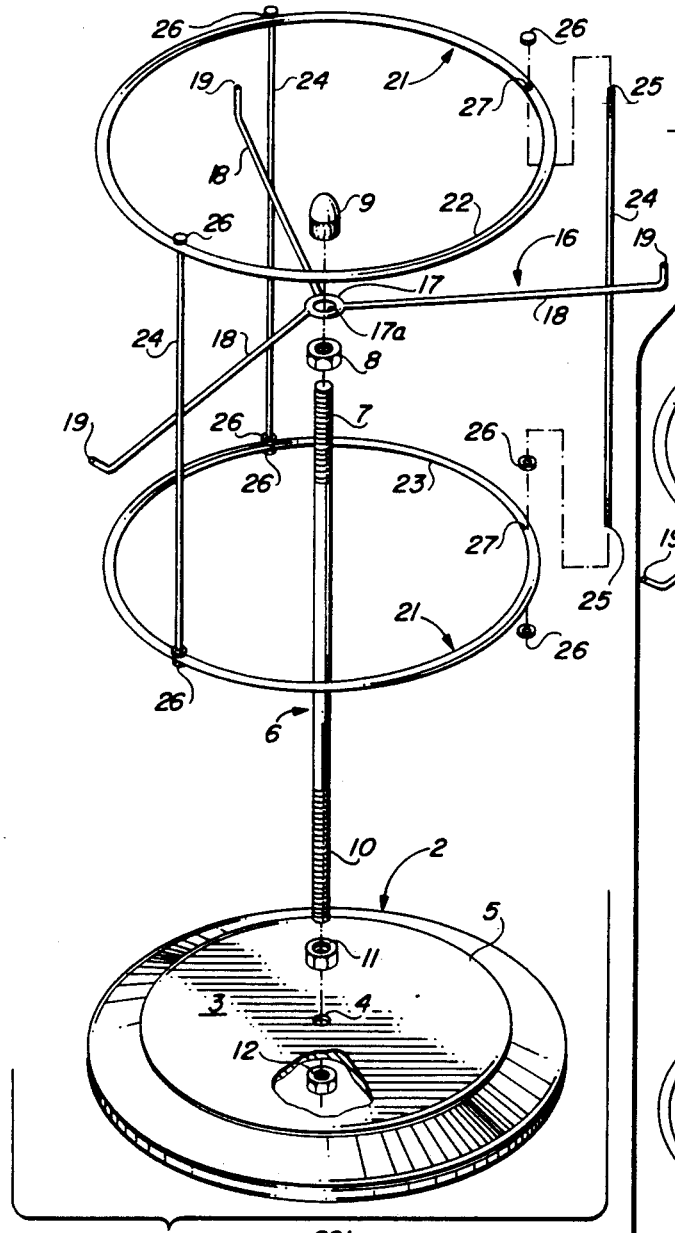
FIG. 6 is an exploded view of the base, support rod, slat frame and strut frame elements of the jewelry caddy illustrated in FIGS. 1 and 4.

Referring initially to FIGS. 1, 4 and 6 of the drawings, the jewelry caddy of this invention is generally illustrated by reference numeral 1. The jewelry caddy 1 is characterized by a circular base 2, fitted with a flat base plate 3, defined by a base plate shoulder 5 and having a base plate opening 4 in the center thereof, as illustrated in FIG. 6. An elongated support rod 6 is provided with top rod threads 7 on the top end thereof and bottom rod threads 10 on the bottom end, which bottom end of the support rod 6 is designed to receive a bottom nut 11 on the bottom rod threads 10 and then to extend through the base plate opening 4 and receive a bottom lock nut 12 on the extending portion of the bottom rod threads 10, as illustrated in FIG. 6. Accordingly, it will be appreciated that the support rod 6 can be made rotatable with respect to the base 2 by loosening the bottom nut 11 or the bottom lock nut 12, as desired. A top nut 8 is first threaded on the top rod threads 7, and the top strut ring 17 of a top strut frame 16 is then inserted over the top end of the support rod 6, such that the top end of the support rod 6 extends through the top ring opening **17*a* of the top strut ring 17, as further illustrated in FIG. 6. The top strut frame 16 is further characterized by three top struts 18, which extend radially outwardly from fixed attachment to, or integral formation with, the top strut ring 17 and the top struts 18 are each terminated by an upward-turned top strut tip 19. A slat frame 21 is characterized by a top frame ring 22 and a bottom frame ring 23, each provided with spaced ring openings 27, for receiving the ends of three frame supports 24, which orient the top frame 22 and bottom frame ring 23 in spaced relationship, as further illustrated in FIG. 6. In a preferred embodiment of the invention the threaded end segments of the frame supports 24 are slightly smaller in diameter than the unthreaded portions of the frame supports 24 and are provided with frame support threads 25, in order to facilitate extension of the threaded end segments of the frame supports 24 through the respective ring openings 27 in the top frame ring 22 and the bottom frame ring 23, to threadably receive corresponding frame support nuts 26. Accordingly, as further illustrated in FIGS. 1 and 6, the bottom frame ring 23 is suspended above the base plate shoulder 5 of the base 2, while the top frame ring 22 rests on the top struts 18 of the top strut frame 16, as illustrated in FIGS. 1, 4 and 6. The top frame ring 22 may be welded or otherwise attached to the top struts 18, as desired, in order to stabilize the slat frame 21 on the top strut frame 16. A bullet-shaped cap nut 9 is threadably attached to the end of the top rod threads 7 which extend through the top ring opening 17*a* of the top strut ring 17, in order to secure the top strut frame 16 on the support rod 6**, as further illustrated in FIG. 1. Alternatively, the cap nut 9 may be welded to, or formed integrally with, the top strut ring 17 and the entire top strut frame 16 threadably mounted on the top rod threads 7 of the support rod 6, as a unit.

Referring now to FIGS. 1–5 of the drawings, the curved slat plates 34 of each of the slats 33 are provided with a top clip 39 and a bottom clip 40, as illustrated in FIGS. 3 and 5, for removable attachment to the top frame ring 22 and the bottom frame ring 23 of the slat frame 21, respectively, as illustrated in FIG. 1. Each of the slat plates 34 is terminated at the top by a top plate margin 35, which removably receives and seats clip-on earrings 28 and at the bottom by a bottom plate margin 36. Multiple slat holes 37 are provided in the slat plates 34, in order to receive the posts 44 of pierced-ear earrings 42 and facilitate display of the decorative elements 43 of the pierced-ear earrings 42, by inserting a retainer 45 on the post 44, as illustrated in FIGS. 3 and 5. In another preferred embodiment of the invention a resilient foam backing 38 of desired thickness may be attached to the concave surface of each of the slat plates 34, in order to facilitate secure, but removable, seating of a retainer 45 on the post 44 of each of the pierced-ear earrings 42 and fitting of the decorative element 43 of the pierced-ear earrings 42 against the outside surface of the slat plate 34. As further illustrated in FIG. 1, the horizontally-disposed, outwardly-extending top struts 18, provided in the top strut frame 16, are designed to receive and support one or more strands of beads 47, as well as rings, broaches, clasps and other items of jewelry (not illustrated). In addition, the upward-standing, bullet-shaped cap nut 9 may be used to support a watch, ring or other item of jewelry, as desired.

It will be further appreciated from a consideration of FIGS. 1–5 of the drawings, that any desired number of spaced slat holes 37 can be provided in slat plates 34 in any spatial orientation to present the pierced-ear earrings in a desired orientation on the jewelry caddy 1. Furthermore, the slat plates 34 can be constructed of plastic, such as "Plexiglass", wood or fiberglass, in non-exclusive particular, in any desired thickness, with or without the foam backing 38, in order to receive as many sets of the pierced-ear earrings 42, as desired. Furthermore, while the top strut frame 16 is illustrated with three outwardly-extending, radial top struts 18, it will be further understood that additional or fewer top struts 18 can be extended from the top strut ring 17 in a top strut frame 16, depending upon the number of strings of beads 47, rings (not illustrated) and other jewelry which must be supported by the top strut frame 16. Moreover, the top struts 18 may be terminated at the top frame ring 22 under circumstances where it is desired to use the top strut frame 16 only to support the slat frame 21 and not for the purpose of supporting jewelry items, such as beads and the like.

Figure 7:
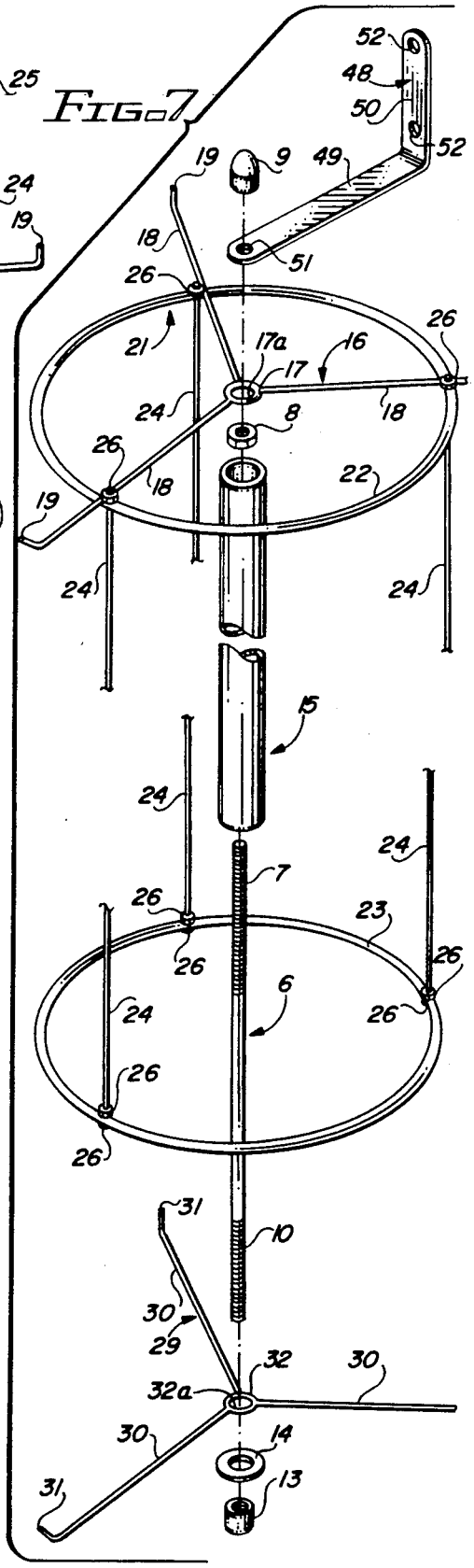
FIG. 7 is an exploded view of an alternative preferred embodiment of the jewelry caddy illustrated in FIG. 1, with a bottom strut frame replacing the base and further including a bracket for supporting the jewelry caddy on a wall.

Referring now to FIGS. 2–5 and 7 of the drawings, in another preferred embodiment of the invention the base 2 is removed from the jewelry caddy 1 and a bottom strut frame 29 is substituted therefor, which bottom strut frame 29 is further characterized by a bottom strut ring 32, having a bottom ring opening 32*a*, with three horizontal bottom struts 30 radially extending from fixed attachment to, or integral formation with, the bottom strut ring 32 and terminating in upward-turned bottom strut tips 31. An L-shaped bracket 48 is characterized by a horizontal leg 49, having a horizontal leg opening 51 therein for insertion on the top end of the support rod 6 and threadable securing on the top rod threads 7 of the support rod 6, by means of the cap nut 9. The upward-turned, vertical leg 50 of the bracket 48 extends from the opposite end of the horizontal leg 49 and is characterized by a spaced mount openings 52, for receiving fasteners (not illustrated) and mounting the bracket 48 to a wall or other support (not illustrated). In another preferred embodiment of the invention, the bottom strut frame 29 is mounted to the bottom end of the support rod 6 by means of a washer 14 and a bottom cap nut 13, which threadably attaches to the bottom rod threads 10, located on the bottom end of the support rod 6. A rod sleeve 15 is seated over the support rod 6 between the top strut ring 17 of the top strut frame 16 and the bottom strut ring 32 of the bottom strut frame 29, respectively, to allow firm seating of the top strut ring 17 and the bottom strut ring 32 on the support rod 6 when the jewelry caddy 1 is assembled as illustrated in FIG. 7.

Figure 8:
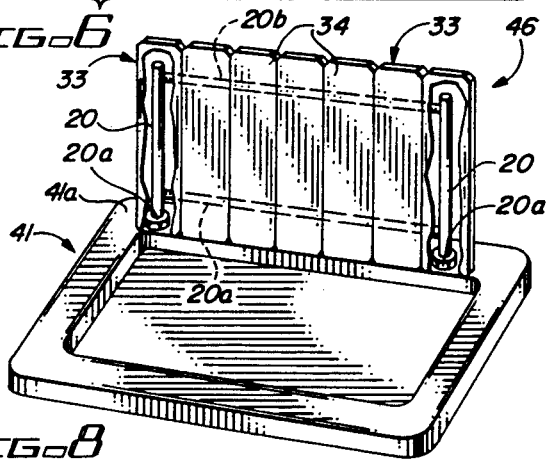
FIG. 8 is a perspective view of yet another preferred embodiment of the jewelry caddy of this invention.

In yet another preferred embodiment of the invention, a tray caddy 46 is characterized by a tray 41, having a flat, horizontal tray edge 41*a* for mounting one end of a pair of slat posts 20. In a most preferred embodiment, the slat posts 20 are threaded at the bottom and are secured to the slat posts 20 by means of a top pair of post nuts 20*a*, as illustrated in FIG. 8, and a corresponding bottom pair of post nuts (not illustrated), which are threaded on the ends of the slat posts 20 and recessed in the bottom of the tray 41. A pair of post struts 20*b* extend horizontally between the slot posts 20 and are attached thereto by welds, (not illustrated), or any convenient means, for removably receiving the top clips 39 and bottom clips 40, attached to each of the slat plates 34 of the slats 33, as illustrated in FIG. 3. Accordingly, various items of jewelry, such as rings, a watch and the like, as well as change, a wallet, sunglasses and other pocket items can be located in the tray 41, while clip-on earrings 28 and pierced-ear earrings 42 are mounted on the slat plates 34 of the slats 33, as illustrated. While the curved slats 33 may be implemented in the tray caddy 46 as described above, it will be appreciated that other slats (not illustrated), having slat plates which are flat may also be mounted on the post struts 20*b*, since the post struts 20*b* are not curved, but rather, present a flat mounting surface.

It will be appreciated from a consideration of the drawings that each of the slats 33 may be quickly and easily removed from, and inserted on the top frame ring 22 and bottom frame ring 23 of the slat frame 21 in the jewelry caddy 1, illustrated in FIGS. 1, 4, 6 and 7 and the post struts 20*b* of the tray caddy 46, illustrated in FIG. 8, in order to mount and remove various sets of pierced-ear earrings 42 and clip-on earrings 28. Accordingly, when it is desired to attach a set of pierced-ear earrings 42 to a selected one of the slats 33, the slat 33 is grasped near the top plate margin 35 and outward pressure on the slat plate 34 disengages the top clip 39 and the bottom clip 40 from the respective top ring 22 and bottom frame ring 23 or the post struts 20*b*, to facilitate insertion of the post 44 through a selected one of the slat holes 37 in the slat plate 34 and through the optional foam backing 38. The retainer 45 is then clipped to the end of the post 44, as illustrated in FIG. 5 and the top clip 39 and bottom clip 40 are again inserted on the top frame ring 22 and bottom frame ring 23, respectively, of the slat frame 21, as illustrated in FIG. 1, or on the post struts 20*b* of the tray caddy 46. Furthermore, the clip-on earrings 28 are easily clipped directly to the top plate margins 35 of the slat plates 34 and various assortments of beads 47 are conveniently suspended from the top struts 18 of the top strut frame 16, while the upward turned top strut tips 19 prevent the beads 47 from inadvertently falling from the top struts 18. In addition, rings, broaches, clasps and other items of jewelry which are susceptible of suspension by the top struts 18 may also be placed thereon. Moreover, as noted above, a watch or ring may be placed on the bullet-shaped cap nut 9, as desired.

It will be appreciated by those skilled in the art that the jewelry caddy 1 and tray caddy 46 of this invention each offer convenient, attractive and highly functional organizers for jewelry of all types, including the facility for supporting, displaying and organizing multiple sets of clip-on earrings 28 and pierced-ear earrings 42, due to the large number of slats 33 and slat holes 37 provided in the respective slat plates 34 of the slats 33. Furthermore, while the jewelry caddy 1 and tray caddy 46 are each useful for organizing jewelry in the home, they may also be used to display and organize jewelry for commercial purposes, depending upon the desire of the user.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A jewelry caddy for organizing jewelry, comprising a base;

an elongated rod having one end attached to said base and upward-standing from said base; at least three struts carried by the opposite end of said rod for supporting first selected pieces of the jewelry; a top frame ring supported by said at least three struts, a bottom frame ring spaced from said top frame ring and at least two vertical frame supports carried by said top frame ring and said bottom frame ring; a plurality of slats disposed around said top frame ring and said bottom frame ring; and clip means provided on said slats for removably securing said slats on said top frame ring and said bottom frame ring for supporting second selected pieces of the jewelry.

2. A jewelry caddy for organizing jewelry comprising an elongated rod, a bracket carried by said rod for securing said rod to a vertical surface; a first strut ring carried by one end of said rod and at least one first strut projecting from said first strut ring, a second strut ring carried by the opposite end of said rod and at least one second strut projecting from said second strut ring, said first strut and said second strut deployed for supporting and organizing first selected pieces of the jewelry; a top frame ring carried by said first strut, a bottom frame ring carried by said second strut and perforated slats removably carried by and spanning both said top frame ring and said bottom frame ring, respectively for supporting second selected pieces of the jewelry.

3. The jewelry caddy of claim 2 wherein said at least one first strut further comprises a plurality of first struts projecting radially from said first strut ring and said at least one second strut further comprises a plurality of second struts projecting radially from said second strut ring.

4. A jewelry caddy for organizing jewelry comprising a tray for receiving first selected pieces of jewelry, a pair of slat posts carried by said tray in substantially vertical, spaced relationship and a pair of post struts carried by said slat posts in horizontal, spaced relationship, and at least one slat carried by said post struts in upward-standing removably relationship for supporting and organizing second selected pieces of jewelry.

* * * * *